United States Patent [19]

deBin

[11] 4,451,249

[45] May 29, 1984

[54] MANUFACTURE OF THERMOPLASTIC BAGS

[76] Inventor: René F. deBin, Denderstraat 54, B-9300 Aalst, Belgium

[21] Appl. No.: 304,405

[22] Filed: Sep. 21, 1981

[30] Foreign Application Priority Data

Sep. 26, 1980 [BE] Belgium ..... 2/58774
Mar. 18, 1981 [GB] United Kingdom ..... 810423

[51] Int. Cl.[3] ..... B31B 23/14; B31B 1/98

[52] U.S. Cl. ..... 493/204; 493/196; 493/926

[58] Field of Search ..... 493/204, 203, 193–197, 493/926, 226, 239, 227, 200, 199; 156/515, 510

[56] References Cited

U.S. PATENT DOCUMENTS

| | | | |
|---|---|---|---|
| 4,181,069 | 1/1980 | Porter | 493/204 X |
| 4,198,260 | 4/1980 | Mundus et al. | 493/204 X |
| 4,270,908 | 6/1981 | Lehmacher | 493/204 |
| 4,308,021 | 12/1981 | Achelpohl | 493/196 |
| 4,342,564 | 8/1982 | Lehmacher | 493/204 X |
| 4,371,365 | 2/1983 | Shingo | 493/204 X |

FOREIGN PATENT DOCUMENTS

DE 928729 1/1981 Fed. Rep. of Germany ..... 493/204

*Primary Examiner*—James F. Coan
*Attorney, Agent, or Firm*—Louis J. Pizzanelli; Richard B. Megley

[57] ABSTRACT

A bag-making machine is disclosed for producing bags from thermoplastic web material. A device (86) for grasping and transferring web segments in an arcuate path for reception by an accumulating device (88) serves to grasp adjacent opposed edges and transfers them through an arc to an accumulating device which includes posts (90).

Accumulation of web segments occurs on a bag stack accumulating and transporting device located between laterally spaced radially projected arms of the web transfer device and it includes an indexing system (94) for translating the stacking posts away from the stacking station. The web segments are subsequently cut and/or joined along a line located centrally of the web segments at a station (102) to thereby produce two individual stacks of bags.

17 Claims, 24 Drawing Figures

MANUFACTURE OF THERMOPLASTIC BAGS

This invention relates to a method of and apparatus for producing thermoplastic bags.

Machines for producing bags from thermoplastic web material come in a variety of configurations depending upon the size and style of bags to be produced and are adaptable to process material of various thicknesses and chemical compositions. Certain bag machines are dedicated to produce one style of bag (side weld or bottom weld) or their design is of a universal character such that by replacement of certain components side weld or bottom weld bags can be made.

Directly or indirectly the object of bag machine developments is to decrease the time to produce a bag. The most important consideration in reducing machine cycle time is substantially wholly dependant upon whether the output of the bag machine can be organized such that successive bags are accumulated in neatly registered stacks with each stack containing a predetermined number of bags. One approach currently practiced to produce registered counted stacks is to utilize a bag stack accumulating conveyor, known as a wicketer. Basically, the accumulating conveyor includes a plurality of sets of pins which are successively positioned at a stacking station and remain there until a predetermined number of bags have been deposited on the pins. By using this procedure each individual bag is provided with a pair of holes whose pitch matches the spacing of the wicket pins. After a predetermined number of bags have been accumulated, advance of the web is arrested and the conveyor carrying the set of pins is indexed to transport a completed bag stack away from the stacking station and to position a succeeding pair of pins at the stacking station.

Machines utilizing a wicket stacker are in very wide use because stacks of several hundred bags of low gauge high density polyethylene can be quickly and accurately stacked since windage problems have a very minimal effect on proper stacking.

According to the present invention in one aspect, there is provided a method of producing thermoplastic bags characterized by the steps of producing segments each defining two bags, transferring the segments successively on one stacking device of an indexing conveyor having a plurality of said stacking devices spaced along its length and engaging the segments on the stacking device at at least one point whereby to retain the segments as a registered stack, and severing the segments of the stack after indexing from the location at which the segments are received on any given stacking device.

According to the present invention in a second aspect, there is provided apparatus for producing thermoplastic bags characterized by means for producing segments each defining two bags, means for transferring the segments successively on to one stacking device of an indexing conveyor having a plurality of said stacking devices spaced along its length and means for engaging the segments when on any given one of said stacking devices at at least one point whereby to retain the segments as a registered stack, and means for severing the segments of the stack after indexing from the location at which the segments are received on any given stacking device.

When it is desired to produce bags from tubular film, certain considerable advantages result in printing the web on one or both sides. More particularly the pattern achievable by the printing press can be duplicated on either side of the longitudinal median of the web, because processing by the bag machinery constructed in accordance with the principles of this invention allows creation of two bags from a web segment.

The rate at which bags made from thermoplastic web material can be produced by both aspects of the invention is double the rate of machine cycle time and the physical characteristics of the material, such as its lack of stiffness, is no longer a factor limiting accurate stacking and stack maintenance when accumulated stacks are transferred to further processing apparatus. More particularly, the process and apparatus of the present invention allow rapid controlled transfer and the creation of stacks containing several hundred web segments when processing the thinnest available low density polyethylene.

Apparatus embodying the invention will now be described, by way of example only, with reference to the accompanying diagrammatic drawings, in which:

FIGS. 1A and 1B, considered together, is a side elevation of a web processing machine;

Figure 19:
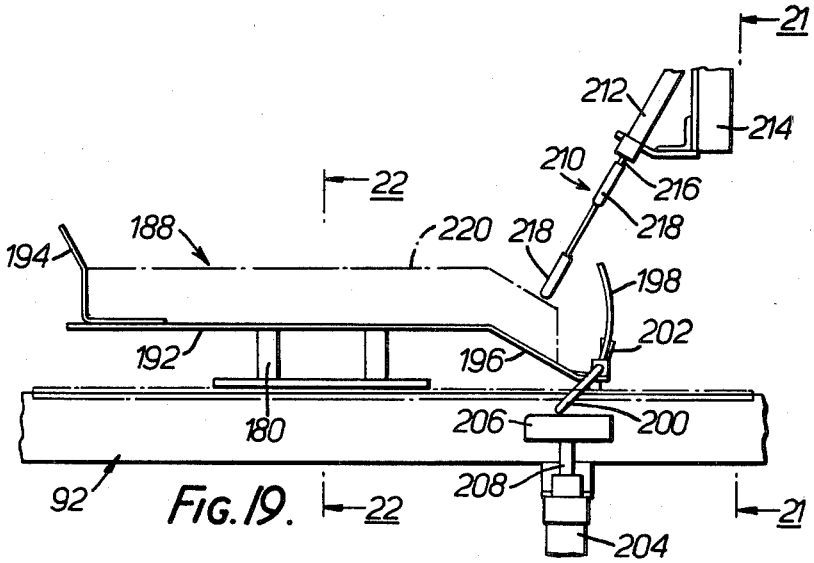
FIG. 19 illustrates, to an enlarged scale, a part of the machine of FIGS. 17 and 18.
Figure 21:
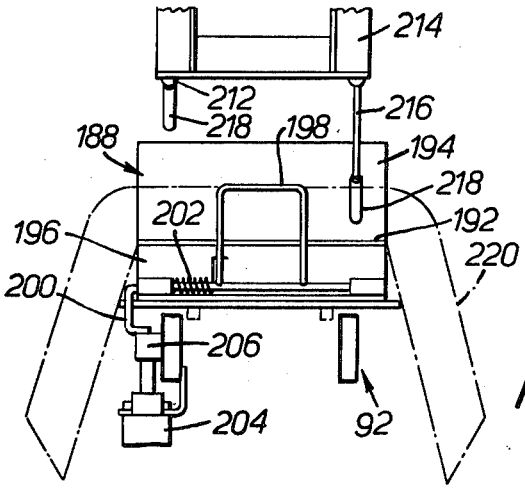
Figure 22:
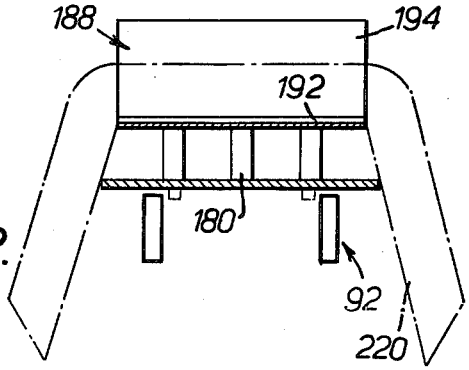
Figure 23:
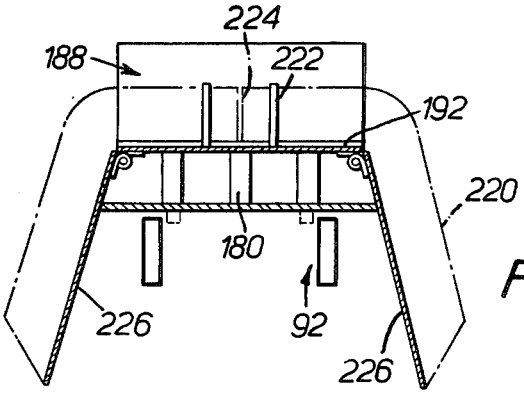

FIGS. 21 and 22 are cross-sections, respectively, on the lines 21—21 and 22—22 of FIG. 19; and FIG. 23 is a cross-section similar to that of FIG. 22, but showing a modification.

Figure 1A:
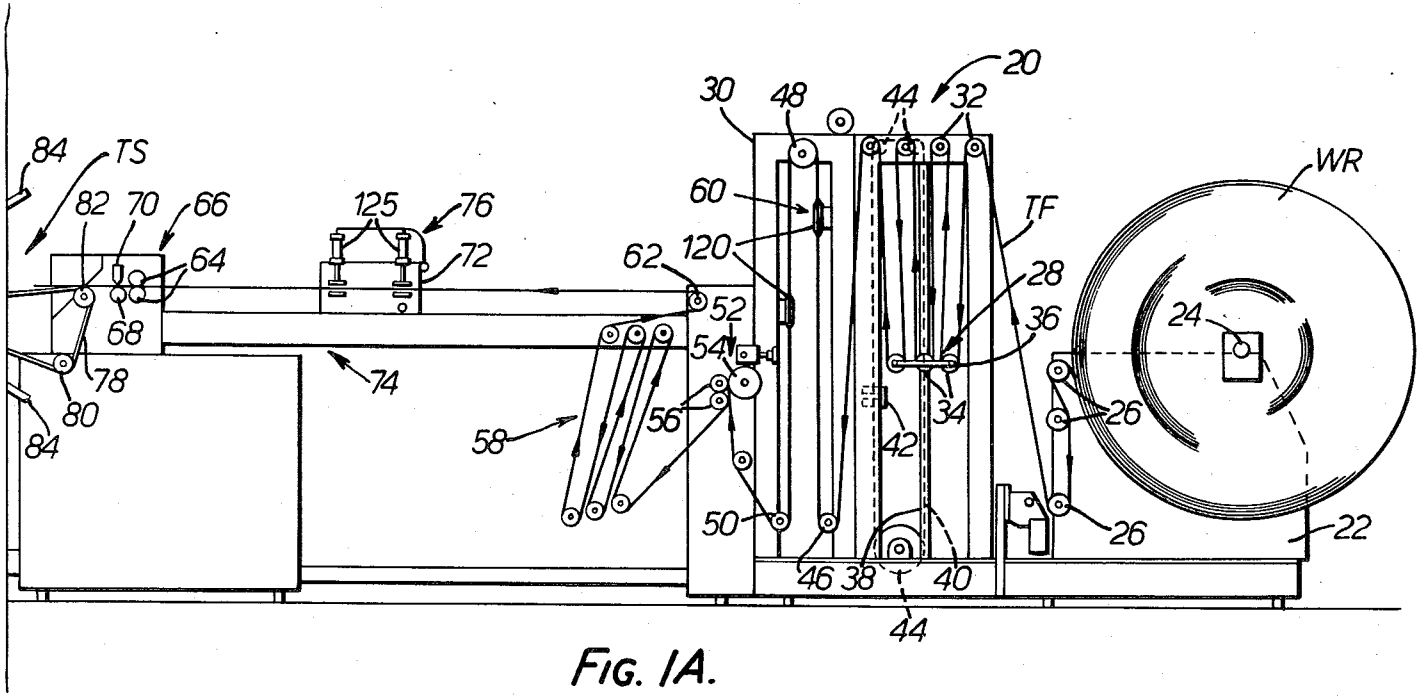
Figure 1B:
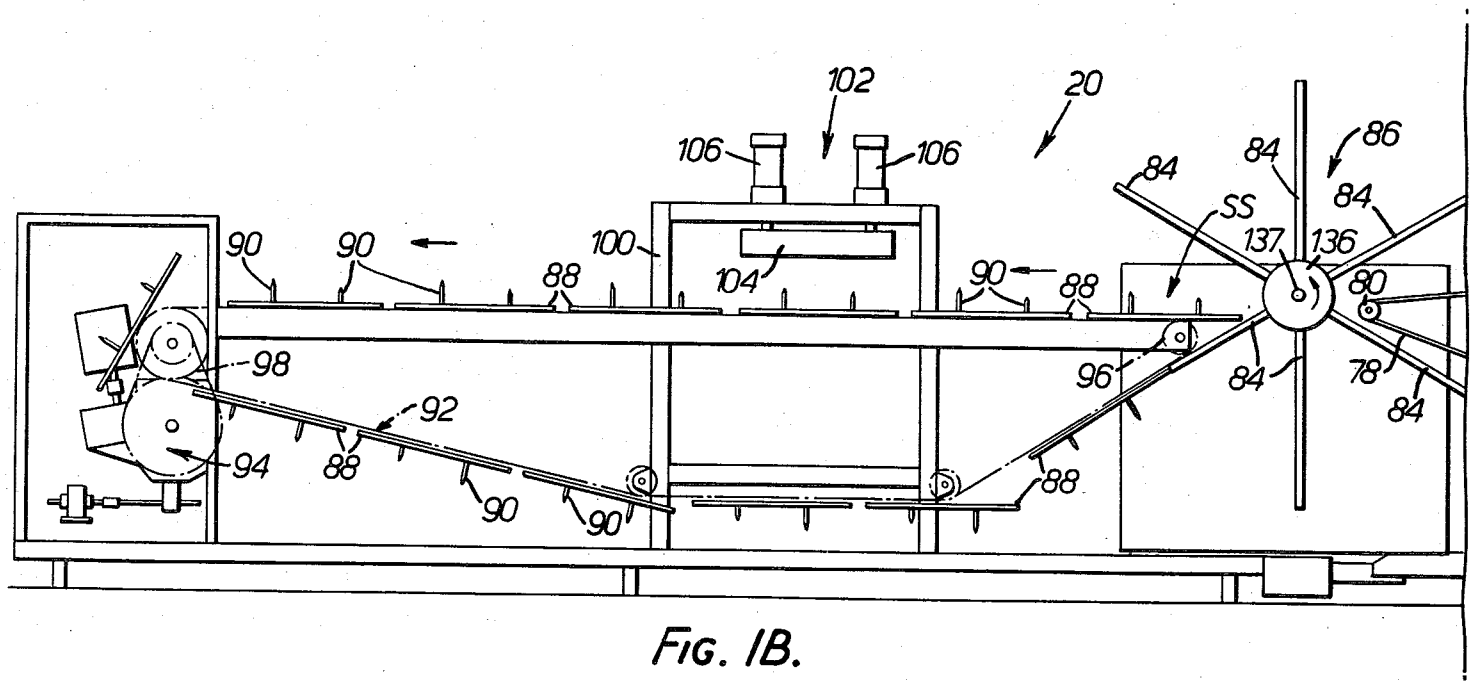

Considering FIGS. 1A and 1B jointly, a web-processing machine in accordance with the invention is generally indicated by 20. The main components of the machine include an unwind stand 22 rotatably supporting, on a shaft 24, a roll of thermoplastic material, hereinafter sometimes referred as a web roll WR, and a plurality of idler rolls 26 directing the thermoplastics film TF to a tension control mechanism 28 mounted in a frame structure 30. The film is threaded around a plurality of stationary idler rolls 32 and a plurality of idler rolls 34 mounted for rotation in a vertically-movable crosshead 36. The crosshead is guided for vertical movement by tubular rods 38 in which is disposed a rope or cable 40 having its ends connected to a weight 42 and, by virtue of pulleys 44, travelling in a generally rectangular loop. The combined weight of the rollers 34 and the crosshead 36 is greater than the weight 42 so that the differential weight allows the crosshead to move downwardly in order to apply tension to the thermoplastic film being looped between the idler rollers 32 and the idler rollers 44. The thermoplastic film is then directed, respectively, around idler rolls 46, 48 and 50 and thereafter the web is directed to a perforating unit 52 including perforating wheels 54 and web drive rolls 56, one of which functions as a platen roll for the perforating wheel 54. The film is thereafter threaded through a dancer unit 58 serving to maintain a predetermined tension on the film portion downstream of the drive rolls 56. Mounted between the idler rolls 46 and 48 and between the idler rolls 48 and 50 are gusset-forming means 60 operating to inwardly fold the opposite edges of the thermoplastic film.

The film web leading from the dancer unit 58 passes over an idler roll 62 and between draw rolls 64 which are adjacent a sealing and severing station 66 which includes a seal roll 68 and a vertically reciprocating seal bar 70 heated to effect sealing and severing of the film to produce web segments of uniform dimension. Between the sealing and severing station and the idler roll 62 and mounted on an accessory section 72 of the bag machine 74, a punching unit 76 is disposed. The punching unit, as will be explained in greater detail hereinafter, is activated during periods of web repose to produce a pattern of four holes in a medial band of the film web.

The portion of film projected beyond the sealing and severing station 66 is supported by a series of laterally spaced belts 78 travelling in a generally triangular orbit defined by idler pulleys 80 and a drive pulley 82. After the web portion projecting beyond the seal bar 70 is severed and sealed, it is immediately grasped by radially-extending arms 84 of a rotary transfer means 86 whose construction and mode of operation are conventional in the art. The arms 84 are provided with a series of holes or orifices connected to a source of vacuum and on coming into contact with the web portion or web segment grasping is effected and the web segment is rotated through an angle of substantially 180° and deposited on a stacking device 88 supporting upwardly-extending pins 90 which are spaced in a pattern substantially identical to the pattern of holes created by the punching unit 76. It will be observed by inspection of FIG. 1B that a plurality of such stacking devices 88 is mounted on a conveyor 92 which is driven by an indexing drive unit 94 and travels in a path determined by idler sprockets 96 and a drive sprocket 98. Along the upper reach of the conveyor 92 and mounted on a frame structure 100, a cutting or a cutting and combination unit 102 for dividing a stack of web segments into two bag stacks is provided.

After a predetermined number of web segments have been stacked on a stacking device, located at a stacking station SS, advance of the thermoplastic film upstream of the sealing and severing station 66 is momentarily arrested so that a successive stacking device 88 is located at the stacking station SS. During creation of a stack of web segments on one of the stacking devices 88, the web segments, on a downstream one of the stacking devices located immediately below the unit 102, are divided by a knife 104 moved downwardly by concurrently operating actuators 106.

Figure 3:
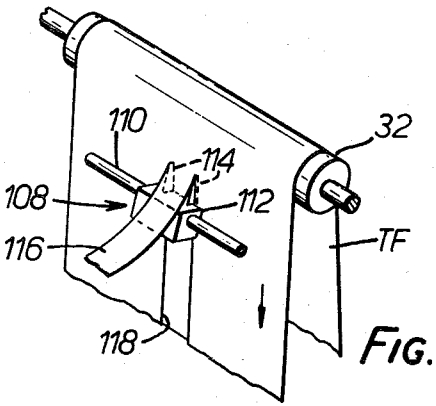
FIG. 3 is a perspective view, to an enlarged scale, illustrating slitting knives for removing a narrow strip of web from tubular film.
Figure 5:
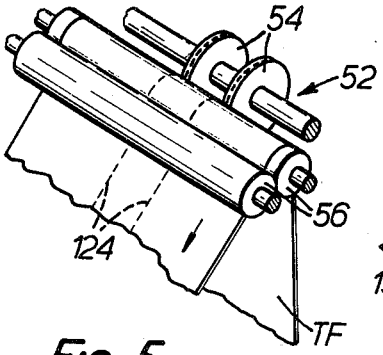
FIG. 5 is a perspective view, to an enlarged scale, illustrating devices for forming spaced lines of perforations in the web tube.

Although it is a common practice to convert plastics film to produce web segments which are stacked and thereafter divided such that each web segment produces two bags, the present invention, by providing a positive transfer and a stacking station constraining each web segment and the completed stack, allows the accumulation of several hundred web segments which are maintained in registry as the completed stack is indexed to a cutting or a cutting and combining mechanism which will hereinafter sometimes be referred to as a cutting and/or blocking unit. The advantages resulting from such a process performed by the disclosed exemplary apparatus, permits the processing of the thinnest available, low-density, polyethylene film and producing lipped bags wherein the lip portion can be very narrow, for example, 25 millimeters or approximately one inch. In the event it is desired to produce lipped bags, (this refers to bags wherein the corresponding edges defining the mouth are uneven or spaced from each other) a slitting device 108 is mounted on the frame structure 30. The slitting device 108 is shown in FIG. 3 and comprises a support rod 110 carried by the frame 30 and a block 112 adjustably fixed to the support rod. The block 112 mounts laterally spaced knives 114 which are orientated to cut and accordingly remove a film strip 116 from one layer of the tubular film and thereby create a gap 118 in one panel of the initially tubular thermoplastic film. Conventional means (not shown) such as a tube connected to a source of vacuum may be provided for disposing of the waste film strip 116.

Figure 4:
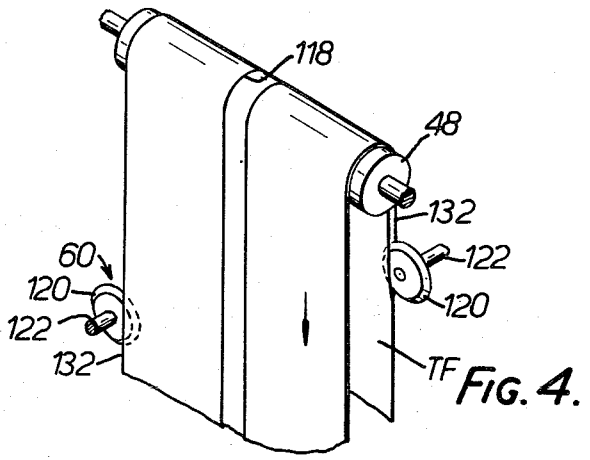
FIG. 4 is a perspective view, to an enlarged scale, illustrating gusset-forming devices.

FIG. 4 illustrates the action of the gusset forming means 60 in which the illustrated form comprises wheels 120 secured to short stub shafts 112 which are freely rotatably mounted on the frame structure 30. Wheels 120 are provided with a bevelled edge to facilitate inward folding of the film and it will be noted that one wheel engages one edge of the film as it approaches the idler roll 48 while the other wheel engages the film as it progresses away from the idler roll 48. If desired, the gusset forming means may consist of two spaced, stationary, flat plates with a wheel or other flat plate accommodated therebetween.

Figure 6:
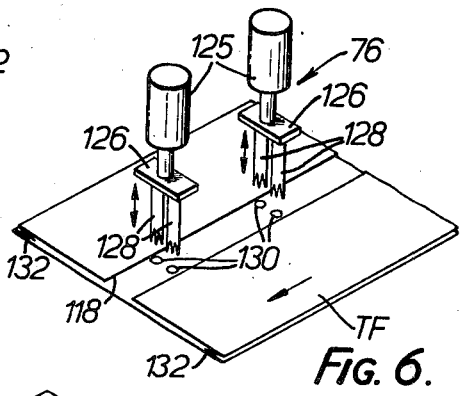
FIG. 6 is a perspective view of punching devices for forming a pattern of holes in a medial band of the web.

In producing another style of bag wherein the edges of the opposed panels forming the mouth are even, the slitting mechanism 108 is either rendered inoperative or removed and perforating mechanism (FIG. 6) is rendered operative to produce spaced lines of perforations 124 on both plies of the gusseted thermoplastic film TF. The central band of the film between the lines of perforations 124 is the zone in which web segment mounting holes are made, as illustrated in FIG. 6, where it will be seen that each actuator 125 has its output rod connected to a plate 126 carrying two hole punches 128. Conventional controls energize the actuators 125 to plunge the hole punches through the thermoplastic film creating four holes 130 in the gap 118 through the thermoplastic film. Punching occurs during the time when the web is momentarily arrested to effect sealing and severing.

Figure 7:
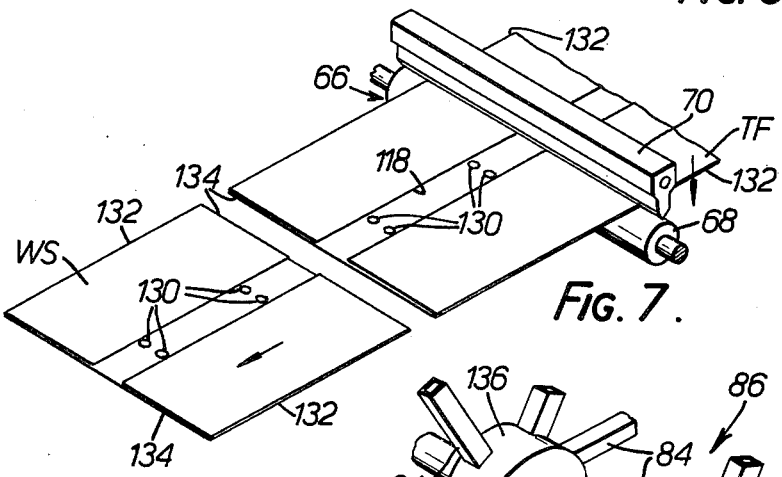
FIG. 7 is a perspective view of a seal bar and seal roll at the sealing and severing station intended to produce a web segment having a pattern of four holes formed therein.

When the gusseted thermoplastic film is fed by the draw roll 64 between the seal roll 68 and the seal bar 70 (FIG. 7) the increment of thermoplastic material projected towards the rotary transfer means 86 will define the longitudinal dimension of the web segment WS and it will be seen to include the pattern of four holes 130, gusseted lateral edges 132 and leading the trailing seals 134. The thermoplastic film illustrated in FIGS. 6 and 7 includes the gap 118 created by removing a film strip 116 by the knives 114. If the apparatus is set up to produce even-edged bags, the thermoplastic film will include the lines of perforation 124 and the four holes 130 in each web segment.

Figure 2:
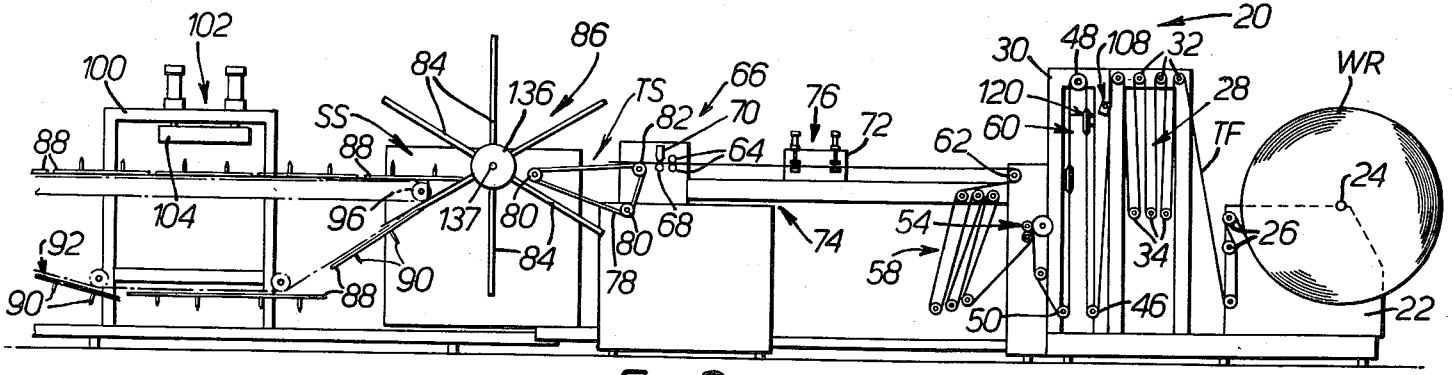
FIG. 2 is also a side elevation to a reduced scale but incorporating mechanisms for producing a different style of bag.
Figure 8:
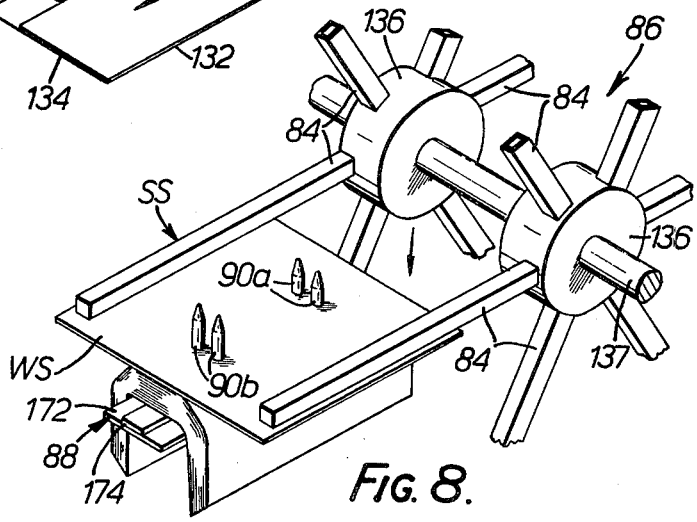
FIG. 8 is a perspective view illustrating placement of a web segment on a stacking device located at the stacking station.

As hereinbefore mentioned, the portion of the thermoplastic film projected beyond the seal roll 68 and the seal bar 70 is supported by a series of laterally spaced belts 78 and upon being severed and sealed, the web segment is grasped by one pair of laterally spaced arms 84 that are downwardly adjacent but moving in a counterclockwise direction (as viewed in FIGS. 1B and 2) to engage and hold, by virtue of the fact that the arms 84 are hollow and are connected to a hollow hub 136 connected to a source of vacuum and mounted on a shaft 137. As each pair of arms approaches the transfer station TS, a web segment is grasped and transferred onto the stacking device 88 located at the stacking station SS as shown in FIG. 8. Collection of web segments on a stacking device continues until a predetermined number of segments have been accumulated. The predetermined number of web segments is determined by conventional counter mechanisms that condition the web feeding draw rolls 64 to stop their intermittent rotation for a sufficient period of time established by the operator to allow the indexing drive unit 94 to move the stacking devices 88 of the upper reach of the conveyor 92 toward the cutting or cutting and combining unit 102. Concurrently, a succeeding, empty stacking device is positioned at the stacking station SS.

The creation of stacks of web segments on each of the stacking devices 88 continues with an interruption occurring when a full complement of web segments have been accumulated on a stacking device. When a stacking device with a full complement of web segments is positioned directly under the unit 102, the web segments are parted or separated along a line CP (FIGS. 14 and 15) located centrally of the edges 132. Stacking on a succeeding device 88 continues during this separation.

Figure 10:
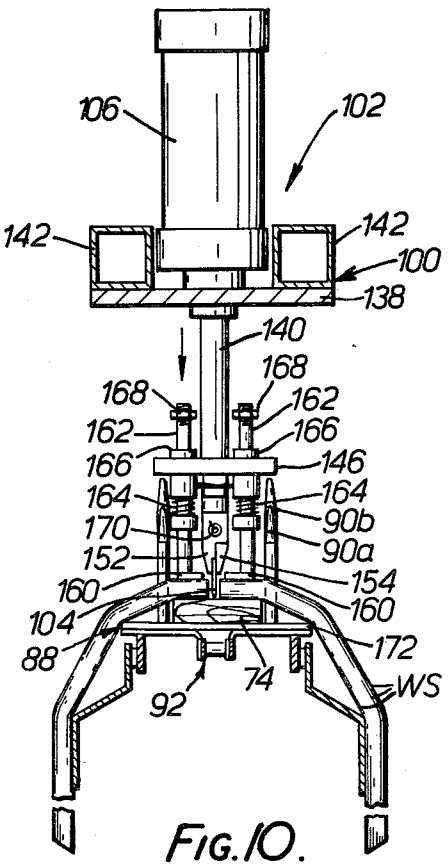
FIGS. 9 and 10 illustrate, respectively, a side and end view, to an enlarged scale, of a cutting mechanism for separating the web segments.
Figure 9:
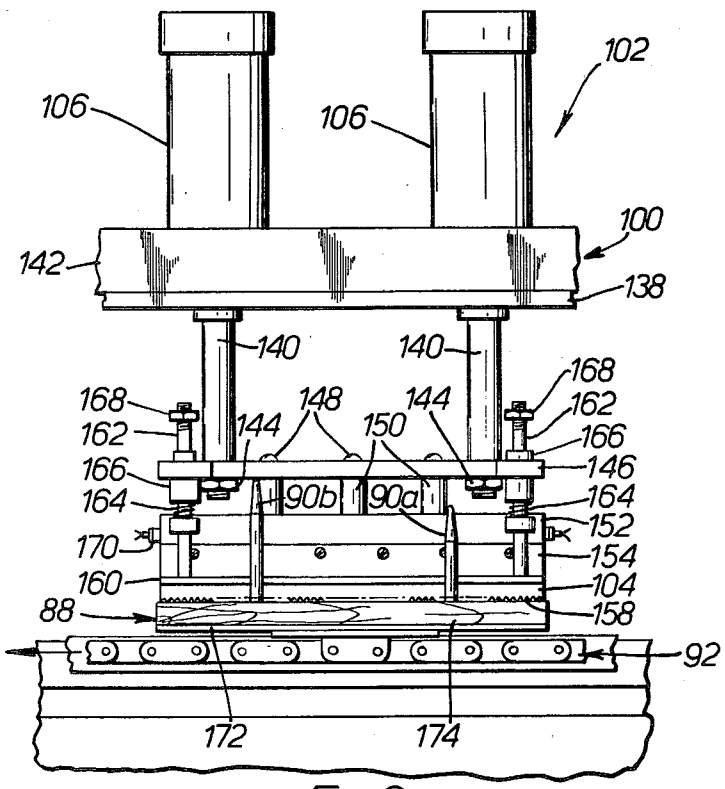
Figure 11:
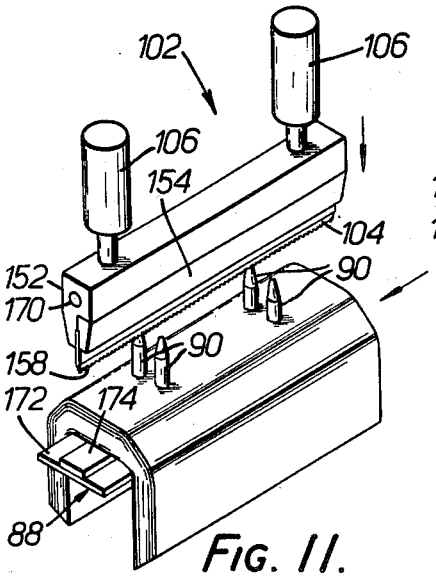
FIG. 11 is a perspective view illustrating a stacking device at the cutting or separating station.
Figure 12:
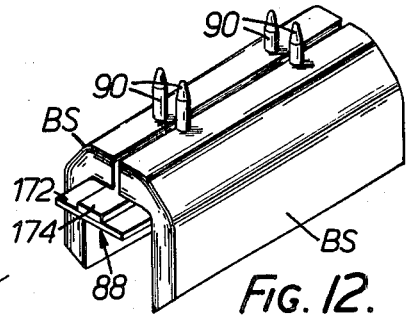
FIG. 12 is another perspective view showing the web segments after they have been severed and being retained by upwardly projecting pins on the stacking device.
Figure 13:
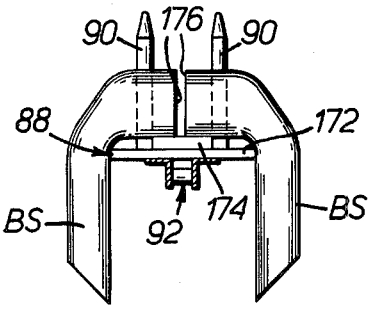
FIG. 13 is an end view of FIG. 12.

FIGS. 9 and 10 illustrate the construction of the cutting or cutting and combining unit 102 while FIGS. 11, 12 and 13 illustrate the mode of operation. It will be seen that the frame 100 includes a plate 138 mounting the pneumatic actuators 106, such that actuator rods 140 project through apertures in the plate 138. To resist bending moments imparted to the plate 138, square section hollow beams 142 are rigidly (as by welding) secured to the plate 138. Fastened to the lower ends of the rods 140, by means of threaded fasteners 144, is a carrier plate 146 having affixed thereto, by means of fasteners 148 and spacers 150, a holder 152, including a clamp bar 154, retaining the knife 104, formed with a sharp, serrated, edge 158. Disposed on opposite sides and closely adjacent to the holder 152 are clamping bars 160, each of which is rigidly connected to guide rods 162 biased downwardly by springs 164. Each guide rod is slidably mounted in bushings 166 secured to the plate 146 and they are retained within the bushings by threaded nuts 168. Reference to FIG. 10 will show that the clamping bars serve to press the stack of web segments downwardly while the knife 104 cuts through the stack of web segments to thereby produce individual bag stacks which are, in addition, retained on the stacking device 88 by the pins **90*a*, 90*b***.

To facilitate cutting or cutting and combining a stack of web segments, heat is supplied to the holder 152 and conducted to the knife 104 carried thereby. Heat is supplied by an elongate, tubular, resistance heater 170 associated with a temperature controller (not shown) in order to adjust the temperature of the knife 104. Cutting without combining or blocking of the severed edges is greatly facilitated if the knife is raised to a temperature of 93° C. to 105° C. This level of temperature has been found to reduce the penetration forces required for the knife to cut through a stack of web segments. When it is desired to cut and combine the severed edges the knife temperature is raised to approximately 298° C. While these temperatures have been found to produce the desired results with certain types of thermoplastic film, skilled operators can determine the temperature levels best suited for the particular requirements of the film used.

Suitable conventional controls are provided for controlling the flow of pressure air to the actuators 106 to effect extension and retraction of the rods 140 and accordingly, accomplish cutting.

To preserve the sharp condition of the knife 104 as it passes through the stack of web segments, the stacking device 88, which comprises a flat rectangular plate 172, also includes a block of wood 174 secured to the plate 172. It has been found that the block of wood 174 provides a very durable reaction surface which allows penetration of the knife to ensure cutting of all web segments and yet prolong the life of the edge of the knife.

Creation of a stack of web segments on the stacking device 88 by impaling successive web segments on the pins, collectively identified by the numeral 90, is reliably ensured by making the pair of pins **90*a* shorter than the pair of pins 90*b* (FIG. 8). The differential elevation of the sets of pins 90*a* and 90*b* is such that a plane containing their ends is substantially co-planar with a plane containing the transfer arms 84. Accordingly, as a web segment is being impaled on the pins 90, penetration of the pins through the holes 130** occurs substantially simultaneously.

FIGS. 11, 12 and 13 illustrate the operation of the cutting or the cutting and combining device which, as mentioned hereinabove, is dependant upon the temperature of the knife 104. When one of the stacking devices 88 is positioned directly below the unit 102, the web segments carried by the pins 90 are divided along the line CP designating the cutting plane. If the temperature of the knife 104 is at approximately 105° C., the web segments are cut (FIG. 12) and the adjacent plies are not joined. Thus, on being cut, two bag stacks BS are created and are maintained on the stacking device by the pins 90. The bag stacks as illustrated in FIG. 12 are formed with a lip produced when the cutting knives 114 remove the strip of material 116.

When it is desired to combine or block the divided web segments, the knife temperature is maintained at approximately 298° C. so that as the knife progresses through the stack of web segments, the edges 176 fuse or weld all of the resulting edges of each bag stack together. When the stacking device carrying two bag stacks progresses beyond the cutting unit 102, unloading of the stacks by the operator can be effected, but the upper reach of the conveyor 92 is such that instantaneous removal is not essential.

Figure 14:
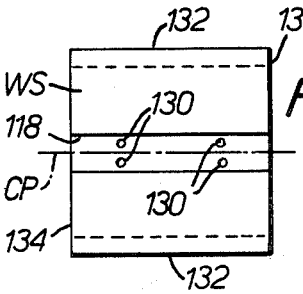
FIGS. 14 and 15 illustrate two styles of bags that can be made by apparatus and the method in accordance with the present invention.
Figure 15:
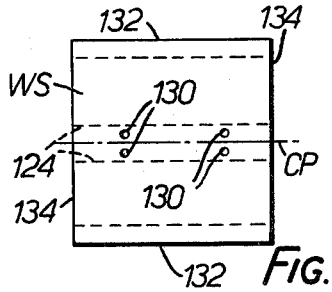

FIGS. 14 and 15 show the configuration of two styles of bags produced by the process and apparatus in accordance with the hereinbefore described embodiment.

FIG. 14 illustrates lipped bags wherein the upper margins defining the bag mouth are uneven, resulting from the removal of the strip 116 to thereby produce the gap 118.

FIG. 15 illustrates the configuration of the web segment when the perforator 52 is rendered operable to produce perforations 124. After the web segments have been divided into individual bags along the line CP, the edges of the bags are even since the lines of perforation 124 are formed in both panels.

Figure 16:
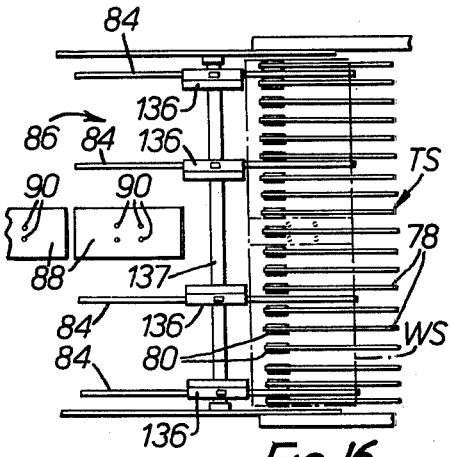
FIG. 16 is a modified form of the transfer mechanism adapted to transfer web segments of greater transverse dimension.

The modification of FIG. 16 illustrates a construction providing the transfer mechanism 86 with the ability to handle web segments WS of greater transverse dimension and yet provide stability and control to the segment as it is transferred. Control is accomplished by providing four hubs 136 and associated radially-extending arms 84 mounted on the shaft 137. On engaging and transferring web segments WS the arms 84 grasp the segment at substantially equally spaced lateral zones to firmly hold the wider web segment.

If it is desired to process a roll of flat single ply material, conventional folding apparatus operating to fold the opposed edge portions toward the longitudinal median of the web to define a gap 118 of desired width, may be used. Using a roll of flat web, folded so that the edges are brought in contact or slightly overlap and subsequently perforating both plies to produce even edged bags has significant advantages in printing since the graphic pattern would exist on both panels of the bags and yet simplify the printing process. To print both panels of bags derived from tubular stock requires a special printing procedure involving passing the web through the press twice.

The second embodiment of apparatus, forming a part only of the bag making machine as a whole, serves only to stack and sever the bag segments, the formation of the bag segments being effected on a machine as described with reference to FIG. 1A or, indeed on any other machine suitable for producing bag segments as hereinbefore described.

Parts similar to those of the first described embodiment will be given the same reference numerals and will not be further described. The main difference in relation to the first embodiment is the employment of clamping means to hold the bag segments in position immediately on completion of transfer of each bag segment from the wheels 86 on to the conveyor 92. The conveyor 78 can be seen in FIG. 18 to have gaps 79 to facilitate lifting the bag segments by the arms 84 of the wheels 86.

Figure 17:
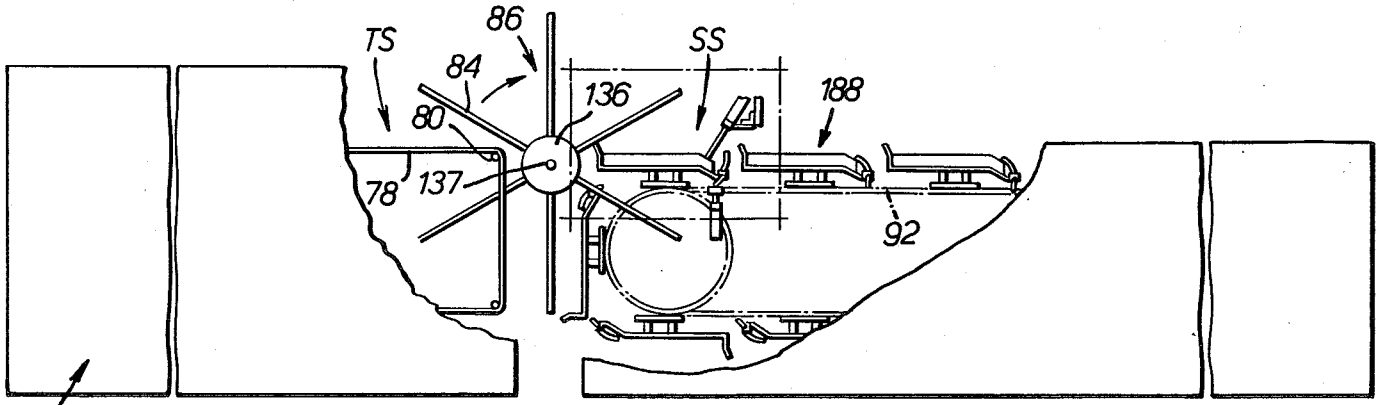
FIG. 17 is a side elevation, with parts cut away to show working details of a second embodiment of a machine in accordance with the invention.
Figure 18:
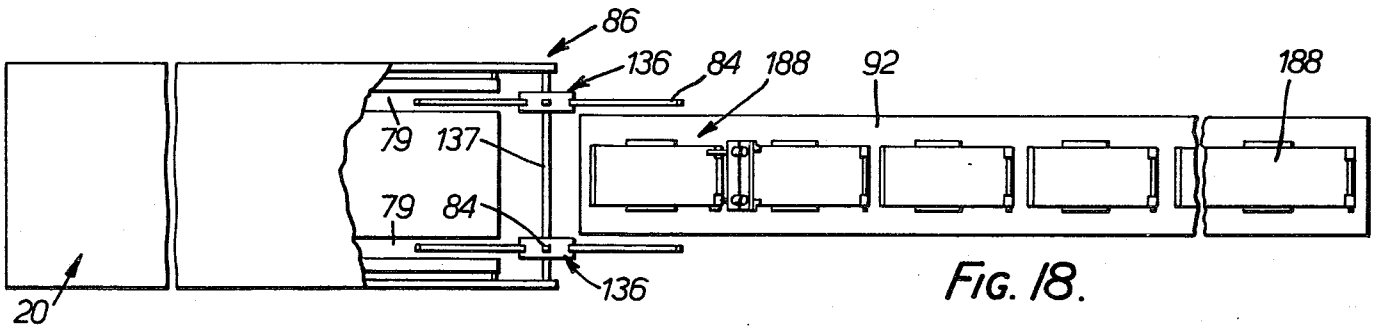
FIG. 18 is a plan view of the machine of FIG. 17.
Figure 20:
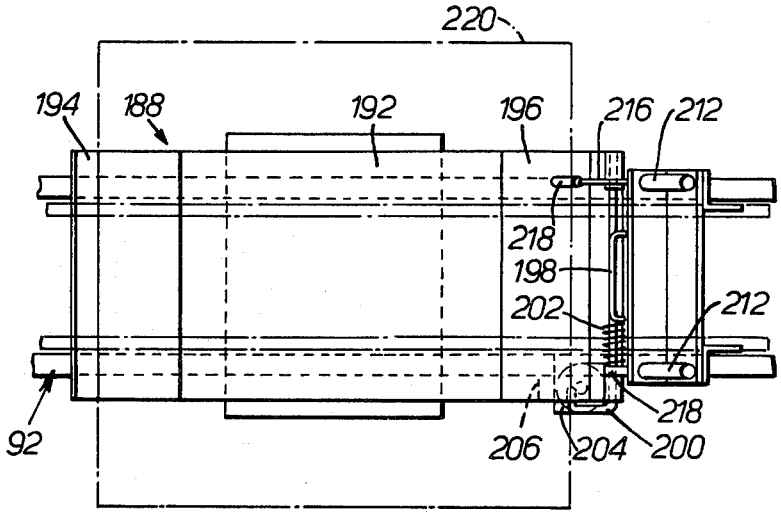
FIG. 20 is a plan view of the detail of FIG. 19.

In place of the stacking devices 88 of the first embodiment, stacking devices 188 are used which are shown in outline in FIGS. 17 and 18 and in detail in FIGS. 19 and 20. Each stacking device 188 includes a plate 192 rigid with a bent-up end stop or guide 194 and formed with a downwardly inclined portion 196 at the forward end of the plate. Means 180 is connected to the conveyor 92 and to the lower surface of the plate 192. The parts of the bag segments lying on the edge portion 196 can co-operate with a clamp 198 pivoted slightly beyond the edge and being in the form of a U-shaped piece of wire. The clamp 198 is rigid with a rod 200 of J-shape with the longer limb connected to the free ends of the U-shaped clamp. A helical spring 202 acts on and encircles the rod 200 which in turn biases the clamp towards the edge portion 196. The clamp can be withdrawn from the edge portion 196 by a pneumatic or hydraulic actuator 204 through the intermediary of a transverse plate 206 mounted on the free end of the piston rod 208 of the actuator.

As each stacking device 188 reaches the stacking station SS, it is disposed to co-operate with a pair of pneumatic actuators 210, the cylinders 212 of which are rigidly mounted on part of the framework 214 of the apparatus. The piston rod 216 of each actuator has an end portion 218 made of or coated with a friction material to assist in gripping the topmost bag segment of the stack. The actuators operate alternately and hence in the side view of FIG. 19 the end portions of both actuators 212 are visible.

The actuators 212 are subject to the action of control means (not shown) which may energize the actuators in dependance upon the angular location of the rotary transfer means 86. Cams, fast for rotation with the transfer means 86 may be used.

In operation, with one of the stacking devices 188 located at a stacking location SS, bag segments 220 (chain lines) are successively delivered by the arms of the wheels 86 with the actuators 212 both in a position at which no clamping or interference with a bag segment being deposited, is caused. Immediately on completion of deposition with one edge of the segment accurately located against the stop or guide 194, one of the friction members 218 will descend and hold the bag segment in position. As the next segment is deposited the first actuator will withdraw the corresponding friction member 218 and the other actuator will descend to clamp the just deposited bag and so on. Alternatively, the actuators may operate synchronously. On completion of the formation of a predetermined number of segments in the stack, the clamp 198 will be allowed to operate by retraction of the actuator 204. The conveyor 92 is then indexed forwardly and the completed stack of segments 220 is removed manually. Owing to the clamp 198 accurate registration will be maintained.

In the meanwhile the bag making machine will have been interrupted for an appropriate number of cycles to enable the conveyor indexing to be completed. The whole cycle of stacking is then resumed, the clamp 198 being withdrawn from the end portion 196 of the plate 192.

The secure and accurately balanced location of the bag segments 220 on the stacking device 188 and the presence of the clamp 198 facilitates the separation of the bag segments to form individual bags and apparatus to effect this may be used as in the first embodiment. The conditions to effect separation and block formation will be the same. If such separation is to be carried out it will be desirable to provide hollow stacking pins or wickets on each stacking device as shown at 222 in FIG. 23. A rotary knife, not shown, preferably heated will form a cut (and seals) at 222.

In the modification of FIGS. 23, each stacking device 188 may incorporate two, opposed, hinged side plates 226, which can be raised after separation to facilitate removal of the completed stacks of bags. Operation of the side plates may be controlled by linear cams.

Although the best mode contemplated for carrying out the present invention has been herein shown and described, it will be apparent that modification and variation may be made without departing from what is regarded to be the subject matter of the invention as defined in the appended claims.

I claim:

1. A method of making thermoplastic bags from a web roll of thermoplastic material which is continually unwound and divided by a sealing and severing device along equally longitudinally spaced lines transverse to its direction of movement to thereby produce web segments of equal dimensions, the improvement comprising punching at least one hole closely adjacent to and on either side of the longitudinal median of the web before division occurs at intervals such that each resulting web segment contains at least two holes, transferring and accumulating each segment as it is produced on a support including posts projecting through said holes and supporting a central portion of the segments such that the remaining portions of the accumulated segments drape downwardly, and cutting an accumulated group of segments along a line substantially central of each segment and between the holes while on the support and thereby produce two bag stacks from the accumulated web segments.

2. The method according to claim 1, wherein the bag stacks created by cutting are retained on the support by the posts after cutting.

3. The method according to claim 1 wherein punching creates four holes in a pattern such that two holes are closely adjacent to and located on either side of the longitudinal median of the web so that each bag stack created by cutting is retained on the support by posts projecting through each hole.

4. A process of stacking and cutting web segments produced from an elongate web strip unwound from a roll of thermoplastic tubular material or flat material folded in a generally C-shaped configuration so that the lateral edges are equally spaced from the longitudinal median of the strip and providing, closely adjacent to and on either side of the longitudinal median, at least one aperture in each web segment which is produced by transversely severing and sealing the web strip at equally spaced longitudinal intervals; the improvement in said process comprising engaging and grasping each web segment on opposite sides of the apertures as it is produced and transferring it to a stacking station; impaling each segment on upwardly projecting pins arranged to conform to the spacing of the apertures and mounted on a support plate positioned at the stacking station and having a length at least equal to the width of the segments and a width substantially less than the length of the segments; translating the support from said stacking station when a desired number of web segments have been impaled on said pins to a cutting or a cutting and combining station; and cutting or cutting and combining the web segments at said last mentioned station by a heated knife located in a plane normal to and containing the longitudinal median of the web segments and thereby divide the stack of web segments into two bag stacks.

5. The method according to claim 4 wherein removal of a central strip from one panel of the tubular material produces bags having uneven edges.

6. The method according to claim 4, further comprising forming, in a central zone of the tubular material, continuous lines of perforation through both panels to produce even edge bags.

7. The method according to claim 4 wherein the knife at said cutting or cutting and combining station is heated in the range of from 93°–105° C., to effect cutting without joining the adjacent plies of web.

8. The method according to claim 4 wherein the knife at said cutting or cutting and combining station is heated to approximately 575 degrees F., to effect combining of the adjacent plies of web to produce a block of interconnected bags.

9. A method of producing thermoplastic bags comprising the steps of forming successive web segments from an elongate strip of thermoplastic film material by intermittently advancing equal lengths of the strip to a transfer station adjacent a severing and sealing device operative to sever and seal the advanced portion to produce the web segment, forming at least one hole on either side of the longitudinal median of the web strip prior to severing and sealing, transferring and accumulating each segment on a support including posts projecting through each of the holes formed in the segment and supporting a central portion of the segments such that the remaining portion drapes downwardly, and cutting an accumulated group of segments along a line substantially central of each segment and thereby produce two bag stacks retained on said support by the posts.

10. A method of converting an elongate strip of tubular or folded thermoplastic web material to produce bags comprising the steps of forming at least two holes at regularly spaced intervals and on opposed sides of the longitudinal median of the web material, transversely severing and sealing the web material to produce substantially identical web segments each of which contain said two holes, deploying a selected length of the web on a generally planar support surface before severing and sealing and thereby produce said web segment, said support surface defining a transfer station, transporting the segment in a generally circular path approximately equal to an arc subtended by a central angle of 180°, depositing the transferred segment on posts projecting through said holes, and cutting the segment along a line between said holes while on the posts.

11. An apparatus for producing thermoplastic bags from a roll of tubular thermoplastic web material comprising means for intermittently advancing equal increments of the web, means extending transversely to the path of web advance for severing and sealing the advanced leading portion of the web and thereby define a web segment, means for forming at least one aperture on either side of the longitudinal median of the web during periods of web repose and before severing and sealing occurs, means for accumulating a predetermined number of web segments on one of a plurality of stacking devices mounted on an indexable conveyor operable to locate successive stacking devices at a stacking station, said conveyor being operable, on accumulating a predetermined number of web segments on one of said stacking devices located at a stacking station, to index said conveyor and position a successive one of said stacking devices at the stacking station, means for transferring each web segment as it is produced on to one of said stacking devices located at the stacking station, mounting posts on each stacking device on which each web segment is impaled, said posts being positioned to correspond to the apertures formed in each web segment, and means in the path of said conveyor and remote from said stacking station for cutting said web segments along the longitudinal median.

12. A bag producing apparatus according to claim 11 wherein said aperture forming means comprises two reciprocable pneumatic actuators each mounting two hole punches, said actuators being spaced longitudinally to produce a pattern of four holes in each web segment.

13. A bag producing apparatus according to claim 11 wherein said stacking device comprises a generally rectangular plate supporting a central portion of the web segments, and a deformable platen penetrated by said cutting means to preserve the edge thereof.

14. A bag producing apparatus according to claim 11 wherein said cutting means comprises a reciprocating knife holder mounting an elongate serrated knife, means for electrically heating said holder and said knife to a desired temperature, and means substantially coextensive with and located on opposite sides of said knife for compressing the accumulating web segments before and while cutting occurs.

15. A bag producing apparatus according to claim 11 wherein said transferring means comprises a pair of arms located on either side of the apertures of said web segments.

16. An apparatus for making two bags from a segment of tubular thermoplastic web material wherein said web segment has a generally rectangular configuration defined by transversely sealing and severing the web at equally spaced longitudinal intervals, removing a narrow strip from the central portion of one web ply and forming apertures located on either side of the longitudinal median and in the central portion of the remaining ply, said apparatus comprising means, having posts mounted on a platform, for accumulating a plurality of web segments with the central portion assuming a generally planar condition and the outer opposed portions draped downwardly, and means for cutting the accumulated segments along a line between the apertures.

17. An apparatus for producing thermoplastic bags from web segments provided with at least one hole on either side and closely adjacent its longitudinal median, said apparatus comprising means for intermittently advancing an elongate web of thermoplastic material, means operable during the period of web repose for forming said one hole on either side of its longitudinal median, means for severing and sealing a portion of said elongate web along a line transverse to the direction of web advance to produce a web segment containing said one hole, means for transferring the segment in an arcuate path to a stack accumulating device, said stack accumulating device comprising upwardly extending posts fixed to a rigid platform, said posts being located to correspond to the spacing of said one hole on either side of the longitudinal median of said web segment so that each segment transferred to said accumulating device is disposed on said posts such that a central area of the segment overlies said rigid platform, means operable upon the accumulation of a selected number of web segments on said rigid platform for translating said accumulating device to a location remote from the location where the accumulation of said web segments occurs, and means at said remote location for cutting or cutting and combining the accumulated web segments along a line between and substantially equally spaced from said holes on either side of the longitudinal median of the web material, said cutting or cutting and combining produces two bag stacks retained on said accumulating device by said posts.

* * * * *